United States Patent [19]

Siebert et al.

[11] 4,292,913

[45] Oct. 6, 1981

[54] BOAT RUB RAIL

[75] Inventors: Lee S. Siebert, Leawood, Kans.; Charles J. Ritsch, Odessa, Mo.

[73] Assignee: Mark Twain Marine Industries, Inc., West Frankfort, Ill.

[21] Appl. No.: 49,434

[22] Filed: Jun. 18, 1979

[51] Int. Cl.[3] ..... B63B 59/02

[52] U.S. Cl. ..... 114/219; 293/126; 267/140; 9/1.5; 9/1.7

[58] Field of Search ..... 267/140; 293/126, 127, 293/128; 24/230.5 R; 9/1.5, 1.7; 150/52 K; 410/104

[56] References Cited

U.S. PATENT DOCUMENTS

| | | | |
|---|---|---|---|
| 1,627,476 | 5/1927 | Barrett | 24/230.5 R |
| 1,843,611 | 2/1932 | Knight | 24/230.5 R |
| 2,570,365 | 10/1951 | Michael | 24/230.5 R |
| 2,764,765 | 10/1956 | Woodruff | 150/52 K |
| 3,065,724 | 11/1962 | Tritt | 114/219 |
| 3,316,012 | 4/1967 | Thier | 150/52 K |
| 3,865,358 | 2/1975 | Butters | 293/128 |

*Primary Examiner*—Trygve M. Blix
*Assistant Examiner*—D. W. Keen
*Attorney, Agent, or Firm*—Lowe, Kokjer, Kircher, Wharton & Bowman

[57] ABSTRACT

A rub rail assembly for a vehicle such as a boat is the subject of the present invention. An extrusion presents a channel that receives a resilient bumper strip. The bumper strip is designed so that deformation of it in an inwardly direction will actually lodge the strip more firmly within the channel. An integral extension of the channel presents a coupling for securing a line to the rail assembly. A second coupling is adapted to be complementally joined with the first coupling for attaching the line.

6 Claims, 4 Drawing Figures

Fig. 1.
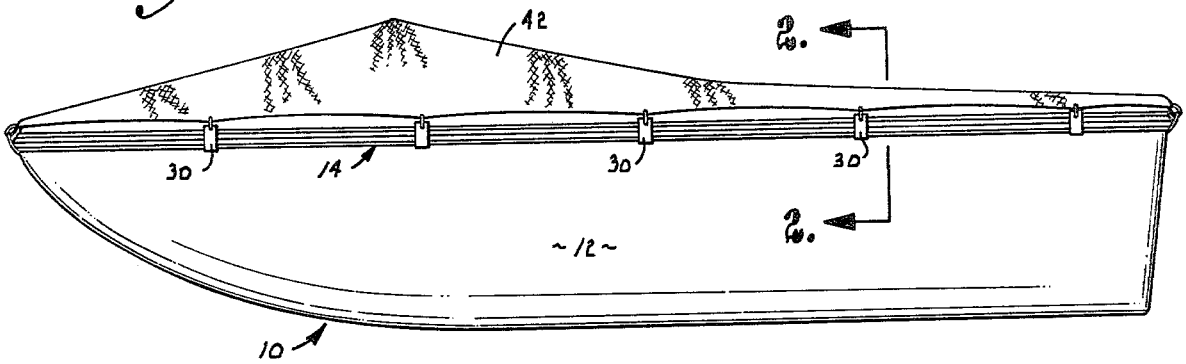
Fig. 2.
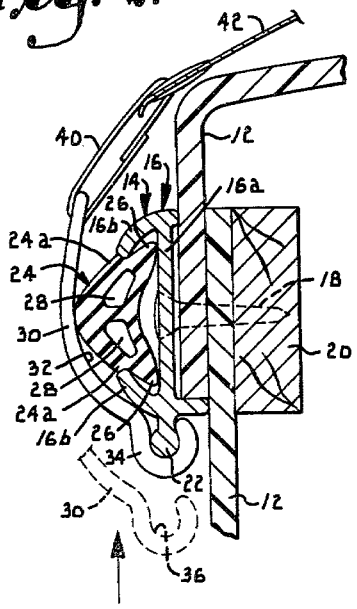
Fig. 3.
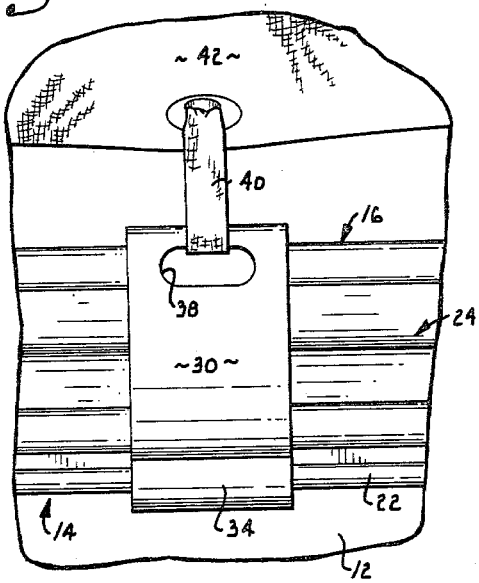
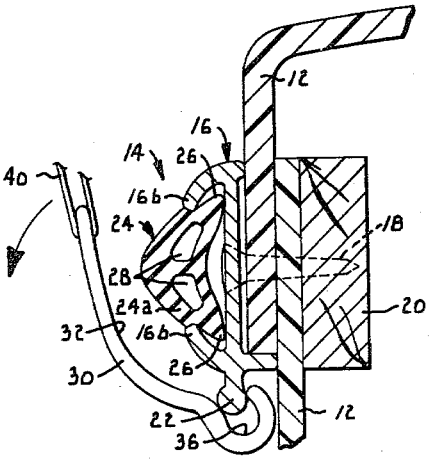
Fig. 4.

BOAT RUB RAIL

This invention relates generally to rub rails to be installed on vehicles and, more particularly, to a rub rail which is designed to receive a coupler for fastening a line to the rub rail.

In many types of vehicle construction it is common to incorporate a rub rail along the side of the vehicle to reduce the possibility of damage in the event the vehicle contacts another object. With certain types of vehicles particularly in the recreational field, it is often desired to secure a covering to the vehicle. For example with both boats and campers a canvas like covering is often used.

Heretofore, it has been necessary to secure a covering through the utilization of special clips or fasteners secured to the side of the vehicle or through long straps or lines that pass around the vehicle. The problem of quickly and securely fastening a covering to a vehicle such as a boat or camper is such that a covering is often not used when it otherwise should be.

To the knowledge of the present applicant, there does not exist any type of fastening device for a cover which is to be installed on a vehicle that does not require special auxiliary fasteners to be secured to the vehicle or that can be removed or installed quickly and with a minimal amount of effort.

It is therefore a primary object of the present invention to provide a rub rail for vehicles which also functions to present a coupler for securing a line to the vehicle.

As a corollary to the above object, an important aim of the invention is to provide a device for securing a line to a vehicle which does not require that auxiliary couplers be mounted on the vehicle in addition to the vehicle rub rail.

An important objective of the invention is to provide a vehicle rub rail and a coupler for the rub rail which is held in place by frictional engagement with the resilient bumper strip of the rub rail.

An important object of the invention is to provide a rub rail for vehicles which also presents a coupler for securing a line wherein the coupler may be installed or removed quickly and efficiently without the need for special tools.

It is an aim of this invention to provide a vehicle rub rail having an expandable bumper strip which provides for enhanced cushioning when the vehicle strikes an object and is also held in place securely even when deformed.

An important object of the invention is to provide a vehicle rub rail which incorporates means for securing a line to the vehicle and which will function as a drip rail for water running off of the vehicle.

Still another of the objects of the invention is to provide a vehicle rub rail which incorporates means for coupling a line to the vehicle wherein the rub rail may serve as a guide for painting a trim stripe parallel to the rub rail.

Other objects of the invention will be made clear or become apparent from the following description and claims when read in light of the accompanying drawing wherein:

FIG. 1 is an elevational view of a boat with the rub rail assembly of the present invention installed;

FIG. 2 is an enlarged vertical cross-sectional view taken along line 2—2 of FIG. 1;

FIG. 3 is a fragmentary side elevational view of the structure shown in cross section in FIG. 2; and FIG. 4 is another vertical cross-sectional view, similar to FIG. 2 but on a slightly reduced scale and illustrating the manner of removing a coupler fastened to the rub rail assembly.

Referring initially to FIGS. 1 and 2 a boat is designated generally by the numeral 10 and is characterized by a hull 12 of fiberglass construction. Secured to the hull is the rub rail assembly of the present invention which is designated generally by the numeral 14.

Assembly 14 comprises an elongated channel presenting extrusion 16 having a generally flat base portion **16*a* and integral curved sidewalls 16*b*. Sidewalls 16*b* face each other and extend in an arc over a portion of base 16*a*. The two sidewalls terminate in spaced apart relationship. Extending through base portion 16*a* and through the hull 12 is a fastener such as screw 18 which is anchored by a wooden block 20** on the inside of the hull.

Integral with and depending from extrusion 16 along the lower side of the latter is a first coupling member in the form of a protrusion 22.

Received within the channel presented by extrusion 16 is a resilient bumper strip 24. Strip 24 is of generally v-shaped cross-sectional configuration with legs 26 extending beneath sidewalls **16*b*. The outside surface of legs 26 is configured to present wings 24*a* which abut the terminal ends of sidewalls 16*b*. The space between the external and internal surfaces of legs 26 is interrupted by two hollow spaces 28 which extend the length of strip 24**.

Referring additionally to FIG. 3, a generally curvilinear clip 30 presents a concave inner surface 32 which is generally complemental to the external surface of bumper strip 24. Integral with and depending from the lower end of surface 32 is a second coupling member 34 which is configured to present a channel 36 that is complemental to protrusion 22. The cross-sectional dimension of channel 36 at its narrowest point is slightly less than the corresponding dimension of protrusion 22. Clip 30 is preferably formed from a relatively rigid but somewhat resilient material so that movement of the clip against protrusion 22 will cause channel 36 to snap fit onto protrusion 22. The end of clip 30 which is opposite coupling member 34 is provided with an elongated slot 38.

Slot 38 is intended to receive a line for securing a device to assembly 14. In FIG. 3 a strap 40 which is coupled with a boat cover 42 is threaded through the slot.

When the assembly 14 as above described is utilized in conjunction with a vehicle such as boat 10, once it is installed it serves as an effective rub rail to protect the boat against damage when coming into contact with other objects. It is to be noted that the design of bumper strip 24 is particularly effective in cushioning the boat in the event of contact with other objects and the bumper strip is designed to be retained within channel 16 notwithstanding deformation as a result of contacting the other objects. To this end, when rub rail 24 is deformed inwardly hollow spaces 28 are able to accomodate a degree of deformation and further inward movement of the bumper strip is accommodated by the space between legs 26 and the space between the end of the legs and the sidewalls **16*b***.

When boat cover 42 is to be installed clips 30 are quickly and efficiently snapped onto protrusion 22 to hold the cover in place. It is to be noted that clips 30 are designed to firmly engage the apex of bumper strip 24 so that the frictional engagement between the two will be sufficient to hold the clip in place relative to protrusion 22.

A clip 30 is removed by simply pulling it downward in the manner indicated in FIG. 4 of the drawing. It will be appreciated that the rub rail assembly of the present invention meets all of the objects heretofore set forth and provides an improved structure which will find application not only with boats but other types of recreational and industrial vehicles.

We claim:

1. A rub rail assembly for a vehicle, which may be employed to secure a device to said rub rail comprising:

a channel member adapted to be secured to the side of said vehicle to provide a channel thereon;

a resilient bumper strip disposed in the channel and projecting outwardly from the plane of said channel member;

a protrusion projecting downwardly from the bottom of said channel member to provide a first coupling member extending substantially continuously along the length of the channel member, said protrusion having a generally rounded exterior surface; and means for presenting a second coupling member adapted to be complementally joined with said first coupling member and characterized by means for attaching said device, said second coupling member presenting a channel recess therein substantially complemental to said protrusion to closely embrace the protrusion in a snap fit therewith.

2. A rub rail assembly as set forth in claim 1, wherein said protrusion is integral and coextensive with said channel member.

3. A rub rail assembly as set forth in claim 2, wherein said bumper strip is characterized by a generally v-shaped cross-sectional configuration and said means presenting a second coupling member engages said bumper strip at the apex of the latter.

4. A rub rail assembly as set forth in claim 3, wherein the frictional resistance between said bumper strip and said means presenting said second coupling member holds the latter in place relative to said first coupling member.

5. A rub rail assembly as set forth in claim 4, wherein said means presenting said second coupling member comprises a resilient material.

6. A boat rub rail assembly for use in securing a boat cover having a plurality of lines fastened thereto, said assembly comprising:

channel presenting means adapted to be secured to the sides of said boat to provide a channel on each side;

a resilient bumper strip of generally v-shaped cross-sectional configuration disposed in said channel and having an apex disposed outwardly from the plane of said channel presenting means;

means depending from and integral with said channel presenting means to present a first coupling member extending the length of said channel presenting means; and means presenting a second coupling member adapted to be complementally joined with said first coupling member and to attach to said lines, said means presenting said second coupling member being characterized by a generally concave inner surface which engages said bumper strip at the apex of said strip when the boat cover is secured, said engagement between said inner surface and apex providing sufficient frictional resistance whereby to hold said second coupling member in place relative to said first coupling member.

* * * * *